United States Patent [19]

Penrose

[11] 4,133,152

[45] Jan. 9, 1979

[54] SET OF TILES FOR COVERING A SURFACE

[76] Inventor: Roger Penrose, Flat 2, 6 Winchester Rd., Oxford, England

[21] Appl. No.: 699,326

[22] Filed: Jun. 24, 1976

[30] Foreign Application Priority Data

Jun. 25, 1975 [GB] United Kingdom ..... 26904/75

[51] Int. Cl.[2] ..... B44F 3/00; B44F 5/00

[52] U.S. Cl. ..... 52/105; 52/311; 273/157 R; 273/156

[58] Field of Search ..... 52/311, 313, 608, 609, 52/590, 105; 404/41, 42, 46, 34; 273/156, 157 R, 157 A

[56] References Cited

U.S. PATENT DOCUMENTS 143,835 10/1873 Muller ..... 273/157

928,320 7/1909 Moore ..... 52/311

FOREIGN PATENT DOCUMENTS 559434 3/1957 Italy ..... 52/311

684021 3/1965 Italy ..... 52/311

OTHER PUBLICATIONS

*New Mathematical Pastimes* by MacMahon, © 1921, Cambridge at the University Press, pp. 50–59.

Mathematical Models by Cundy & Rollett © 1964, Oxford University Press, pp. 18–27, 60–65, 93, 154–157.

*Primary Examiner*—Price C. Faw, Jr.

*Assistant Examiner*—Henry Roduazo

*Attorney, Agent, or Firm*—Brisebois & Kruger

[57] ABSTRACT

A set of tiles for covering a surface is composed of two types of tile. Each type is basically quadrilateral in shape and the respective shapes are such that if a multiplicity of tiles are juxtaposed in a matching configuration, which may be prescribed by matching markings or shapings, the pattern which they form is necessarily non-repetitive, giving a considerable esthetic appeal to the eye. The tiles of the invention may be used to form an instructive game or as a visually attractive floor or wall covering or the like.

11 Claims, 28 Drawing Figures

SET OF TILES FOR COVERING A SURFACE

BACKGROUND OF THE INVENTION. FIELD OF ART

The invention originates in that field of geometry known as tessellation, concerned with the covering of prescribed areas with tiles of prescribed shapes. This field has found practical application not only to the design of paving and wall-coverings but also in the production of toys and games. In both instances, not only is the purely geometric aspect of complete covering of the surface of importance, but the esthetic appeal of the completed tessellation has equal significance in the eye of the beholder.

BACKGROUND OF THE INVENTION. STATE OF PRIOR ART

In the general field of tessellation, symmetry obviously plays an important part. Lattices having diad, triad, tetrad and hexad axes are particularly amenable to tessellations, but the results are noticeably repetitive. It has recently been proposed to incorporate pentagonal symmetry into a tessellation, using four differently shaped tiles to overcome the problem that a purely pentad-based lattice cannot be extended indefinitely. This tessellation is non-repetitive, since it has no period parallelogram, but the use of four distinct tile shapes which require correct matching is a relatively cumbersome technique from a practical point of view in spite of the basic geometric elegance.

SUMMARY OF THE INVENTION

According to the present invention, a set of tiles for covering a surface comprises tiles of two shapes, so dimensioned that they may be juxtaposed in a matching configuration to form a continuous assembly in which each tile is associated with a respective cell of a pentaplex lattice.

Consider a pair of quadrilateral figures each of which has at least one diagonal line of symmetry, and has at each apex an included angle which is 36° or an integral multiple thereof. Assume further that the two edges of one of the figures on one side of its line of symmetry are capable of identical matching, as regards length and sense, with the two corresponding edges of the other figure. If a plurality of such figures are juxtaposed in a matching configuration to cover a plane surface, and it is necessarily found that, as a consequence of the design of the figures, the pattern which they form is non-repetitive, i.e. it does not exhibit a period parallelogram, the pseudo-lattice formed by the apexes of the assembly of figures will be referred to herein as a "pentaplex lattice". The area of the two figures forming a pentaplex lattice are in the ratio of the "golden section", i.e. $(1 + \sqrt{5}/2) : 1$, and as the extent of the pentaplex lattice tends towards infinity, the ratio of the numbers of the two types of figure approaches the same quantity.

In one aspect of the invention, a toy or game comprises a set of tiles as defined above. In one embodiment of the invention, the two shapes of tile are the respective shapes of the two figures forming a pentaplex lattice. In one modification of the invention the tiles may be formed with complementary edges, of non straight-line shape, but with their apexes coincident with the corresponding apexes of the two figures forming the pentaplex lattice. In a further modification the apexes of each shape of tile may depart from such coincidence, provided that when juxtaposed the two shapes exhibit a contour passing through the nodes of the corresponding adjacent cells of the pentaplex lattice.

In any of the above-mentioned variants of the invention, the edges of the tiles may be marked to indicate a correct sense of matching. Alternatively or additionally, the edges may be formed with complementary interlocking forms. Surface markings may also be applied to the tiles either to emphasize the individual tiles in an assembly or to emphasize the development of a non-repeating pattern based on five-fold symmetry.

It will be readily understood that it is possible without departing from the basis of the invention, to subdivide the tiles referred to above into smaller sub-elements and so shape or mark them that when assembled they form in effect a set of tiles of the type discussed above. Thus for example each type of tile could be subdivided and each part marked for matching to ensure necessary reconstruction in the form of the original tile as building of the tessellation continued, or two main types of tile could be provided such that the tessellation develops with vacent areas of standard size and shape, further tiles of said standard size and shape being provided to fill said vacant areas.

The tiles referred to in relation to the invention need not be used in a toy or game, but may alternatively be used as a decorative covering tile, exploiting the non-repetitive form of the assembly. In either case a "foreign" piece, having edges compatible with the standard tiles, but different in form from either, may be included. Such a piece will restrict the freedom of choice of matching throughout the assembly, and may produce a final assembly which is not only non-repetitive, but in fact unique to that "foreign" piece.

DETAILED DESCRIPTION OF THE EMBODIMENTS

Figure 1A:
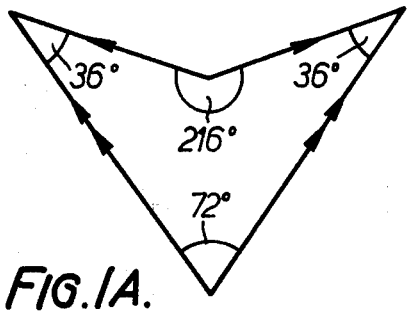
FIGS. 1A and 1B are the respective figures of a first pentaplex pair.
Figure 1B:
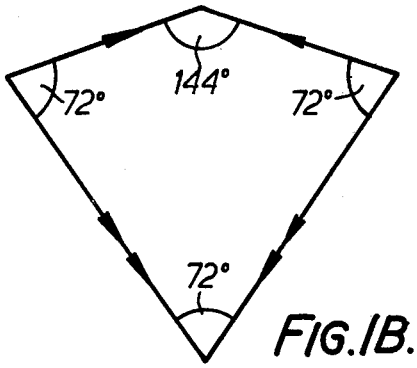
Figure 2A:
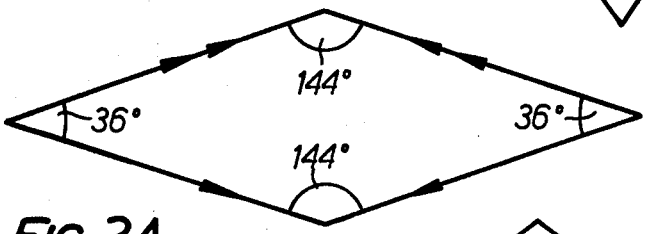
FIGS. 2A and 2B are the respective figures of a second pentaplex pair.
Figure 2B:
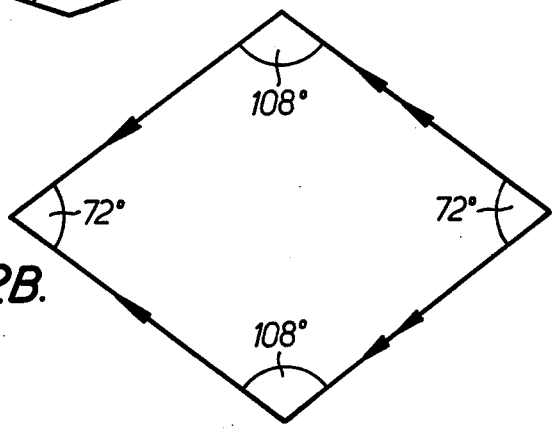

Referring to the drawings, FIGS. 1 and 2 show respectively the figures of the two basic pentaplex pairs which have been devised in connection with the present invention. In each case, the arrow marked on the figures indicate the required matching of the edge of figures when they are used to construct a pentaplex lattice by juxtaposition. Thus an edge with a single headed arrow is matched with another edge similarly marked on an identical or complementary figure, both arrows pointing in the same direction. Pentaplex lattices formed from both basic pentaplex pairs will be discussed in the following description.

Figure 3A:
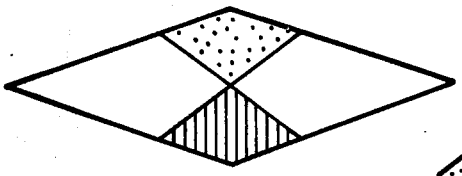
FIGS. 3A and 3B show the tiles of a pair according to the invention, with surface markings to emphasize the development of a non-repeating pattern based on five-fold symmetry.
Figure 3B:
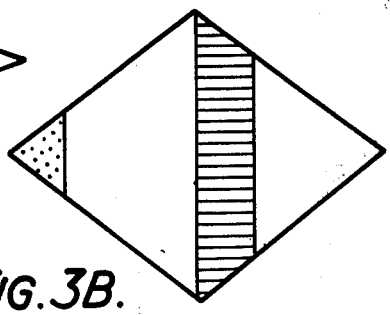
Figure 4:
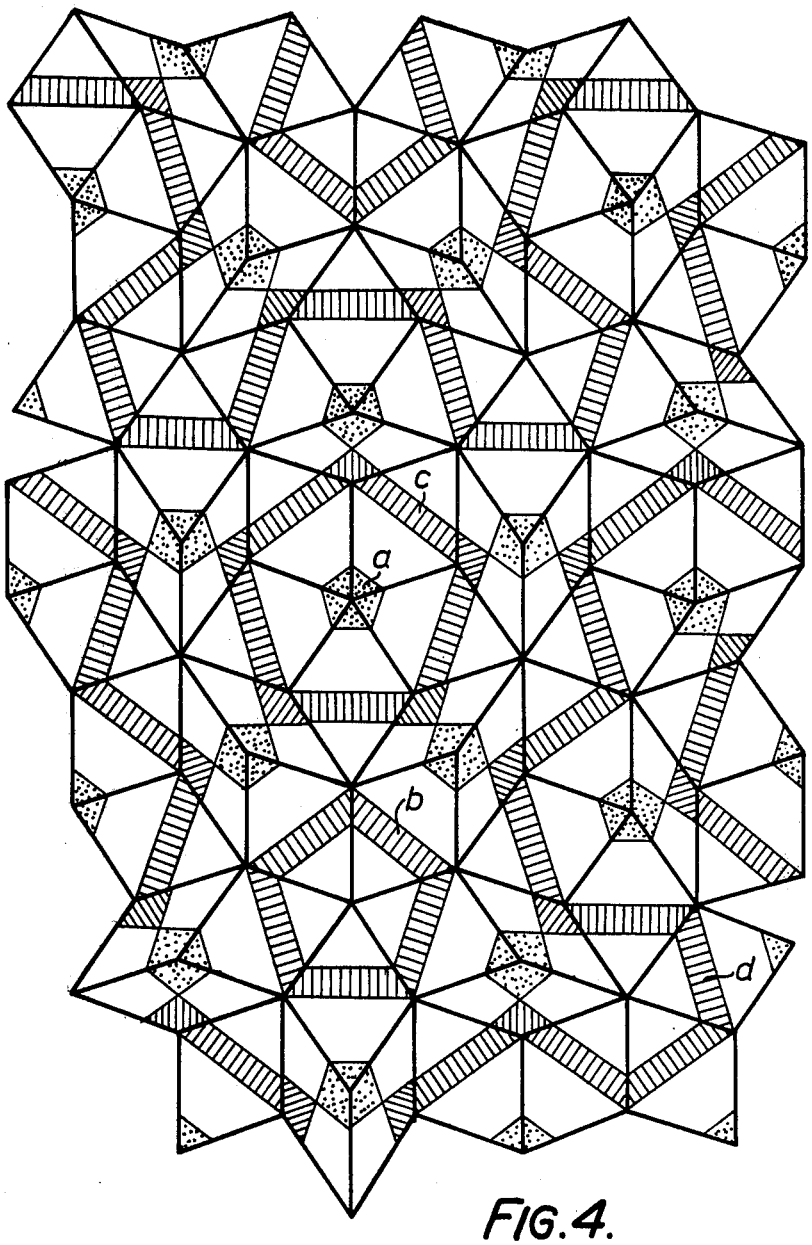
FIG. 4 shows a section of an assembly of tiles of the kind shown in FIGS. 3A and 3B, FIGS. 5A and 5B indicate variations in the shape of the two types of edge of the first pentaplex pair.

FIGS. 3A and 3B show a possible form of marking for the members of a set of tiles shaped as the figures of the second basic pentaplex pair. The markings serve the purpose of prescribing the matching of juxtaposed tile edges, and furthermore are so disposed on the tiles that when a set of tiles is juxtaposed to form a continuous plane surface, the non-repeating pattern of the assembly, based on the five-fold symmetry of the tiles, is emphasised. FIG. 4 shows a section of such as assembly, and this section will be used an an example to illustrate the basic nature of a pentaplex lattice.

It will be observed by inspection of FIG. 4 that the shape of the tiles of the pentaplex pair is such that they can be juxtaposed to cover a plane surface, and that it is therefore meaningful to speak of a pseudo-lattice having its nodes at the apexes of the tiles. The angles included at the apexes of the tiles are characteristic of five-fold symmetry, and it is clear from FIG. 4 that short-range areas of five-fold symmetry do occur, as for example at a, b and c. These areas can be readily identified by inspection of the markings of the tiles, since these are such as to emphasize the overall pattern developed by the assembly. It is well-known, however, that the geometry of five-fold symmetry is such that a repeating lattice cannot be consistently developed by the operation of a pentagonal system of symmetry, since the angular requirements of adjacent "pentad" axes are incompatible. The assembly of FIG. 4 exhibits breakdown of the pure five-fold symmetry over intermediate ranges, as for example in the hatched line indicated at d, but such features may in turn be found to form parts of a longer range five-fold symmetry.

Although the section of the assembly illustrated in FIG. 4 is of limited extent, it indicates fairly clearly the manner in which the pattern of a pentaplex lattice develops without repetition, and it may be calculated that there is no period parallelogram in such an array, i.e. there is no basic parallelogram which contains sufficient of the elements of the array and can be re-duplicated to synthesise the array.

Figure 5A:
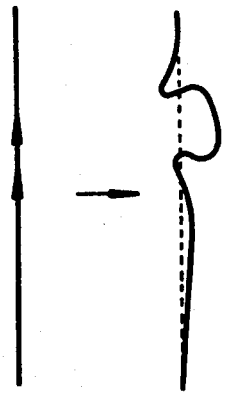
Figure 5B:
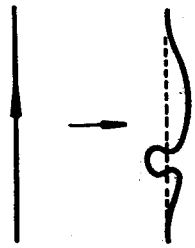
Figure 6A:
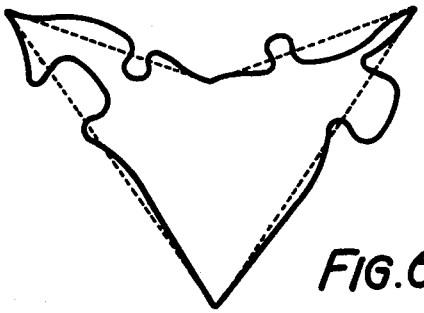
FIGS. 6A and 6B show the tiles of a pair constructed on the basis of FIGS. 1A and 1B with the modification of FIGS. 5A and 5B, FIGS. 7A and 7B indicate variations in the shapes of the two types of edge of the second pentaplex pair.
Figure 6B:
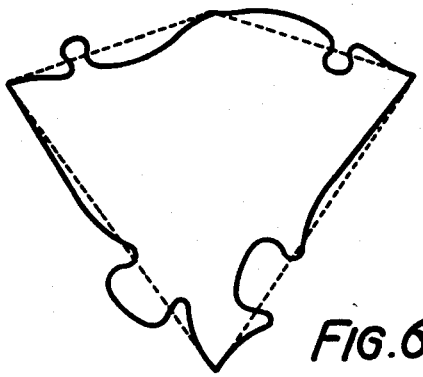
Figure 7A:
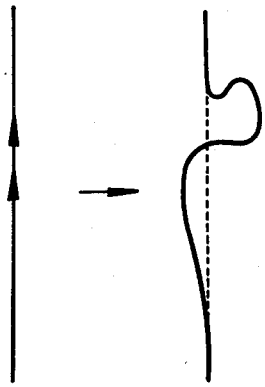
Figure 7B:
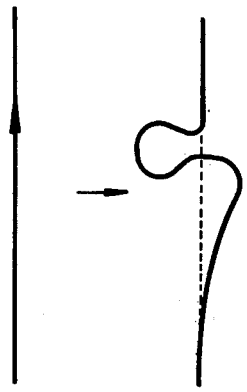
Figure 8A:
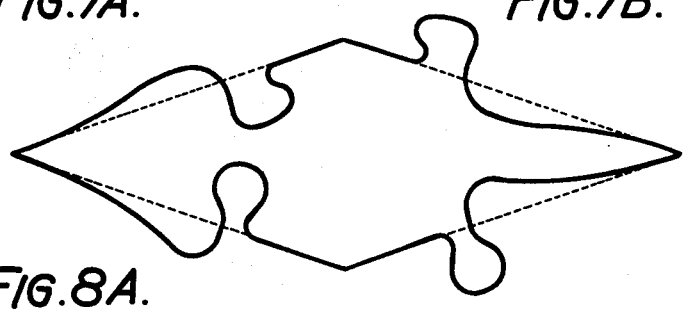
FIGS. 8A and 8B show the tiles of a pair constructed on the basis of FIGS. 2A and 2B with the modification of FIGS. 7A and 7B, FIGS. 9A and 9B indicate a further variation in the shape of the two types of edge of the first pentaplex pair.
Figure 8B:
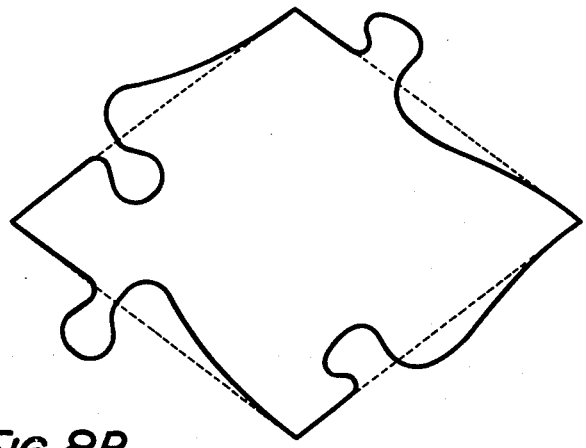

It is possible to modifiy the tiles away from shapes of the basic pentaplex pairs in order to provide for their interlocking when juxtaposed. FIG. 5 illustrates one such modification. The modifications to the two types of edge of the figures of the first pentaplex pair are specified in FIGS. 5A and 5B respectively, and the resultant tile shapes are shown in FIGS. 6A and 6B respectively. It will be observed that the apexes of the modified tiles coincide with those of the basic shapes of the pentaplex pair (shown in dotted lines in both FIGS. 5 and 6) and it will be understood that the formation of an array of modified tiles will be fully analogous to the case of unmodified tiles, each tile being associated with a corresponding cell of the pentaplex lattice. Corresponding variations in the case of the second pentaplex pair are shown in FIGS. 7 and 8.

Figure 9A:
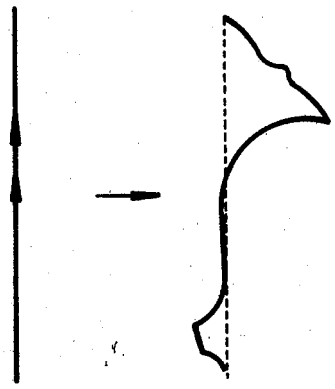
Figure 9B:
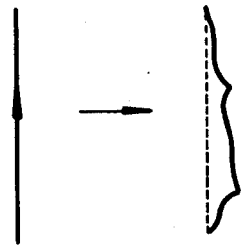

Apart from the purpose of interlocking, the shape of the tiles may depart from the basic form for other esthetic reasons. For example, the modification to the shape of the first basic pentaplex pair indicated in FIG. 9 results in tiles of the form shown in FIG. 10, which are so shaped that they may be provided with surface markings in the design of birds. An assembly of such tiles, with the design indicated, is shown in FIG. 11. Another feature of this pair of tiles is that in each case only three apexes of the basic pentaplex figures are coincident with apexes of the tiles. However, it can be seen from the drawings that when a pair of tiles is juxtaposed, the "free" apexes of the resultant compound shape fall on the "free" nodes of the two corresponding pentaplex lattice cells.

Figure 10A:
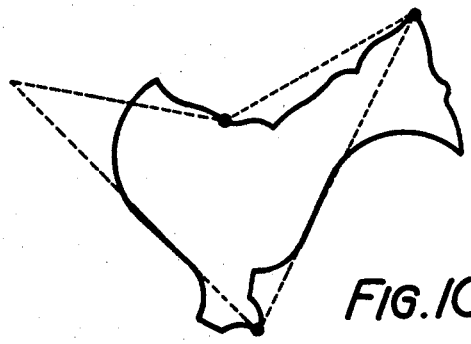
FIGS. 10A and 10B show the tiles of a pair constructed on the basis of FIGS. 1A and 1B with the modification of FIGS. 9A and 9B, FIG. 11 show a section of an assembly of tiles of the kind shown in FIGS. 10A and 10B with surface markings to emphasize the individual tiles.
Figure 10B:
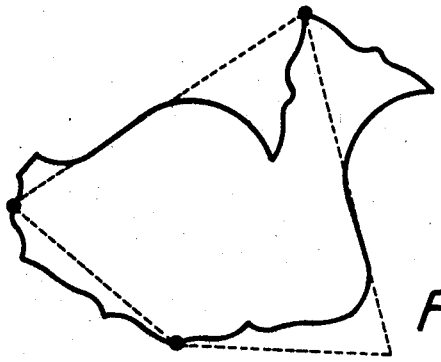
Figure 11:
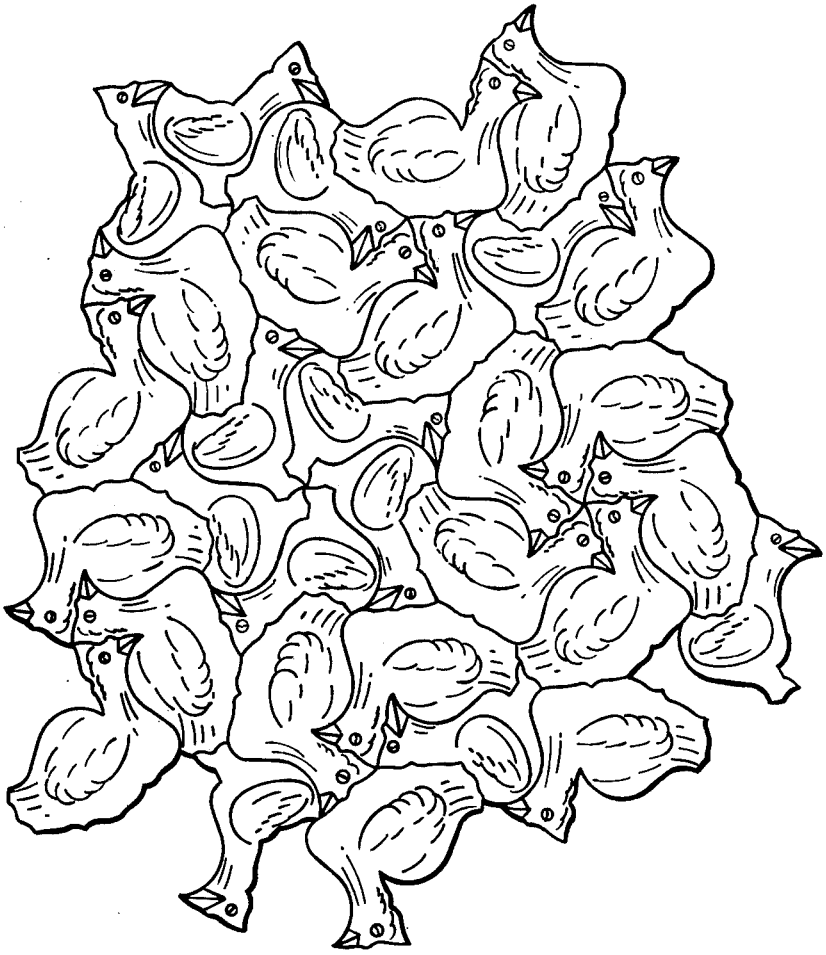
Figure 12A:
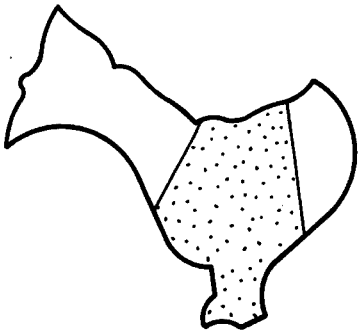
FIGS. 12A and 12B show alternative markings for the tiles of FIGS. 10A and 10B which will emphasize the development of a non-repeating pattern based on five-fold symmetry.
Figure 12B:
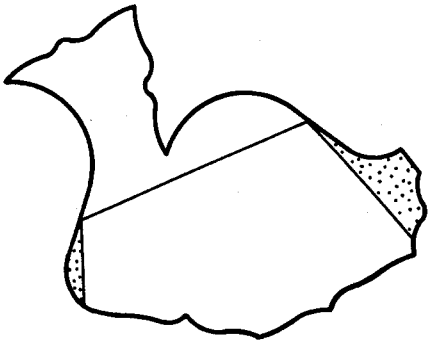
Figure 13A:
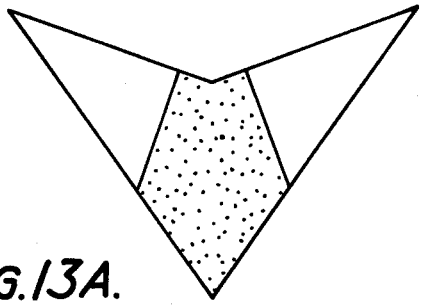
FIGS. 13A and 13B show tiles shaped according to the figures of the first pentaplex pair, carrying surface markings which will emphasise the development of a non-repeating pattern based on five-fold symmetry.
Figure 13B:
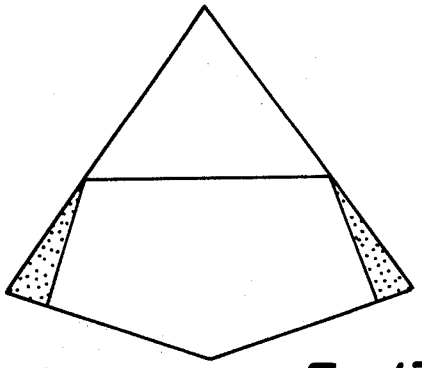
Figure 14:
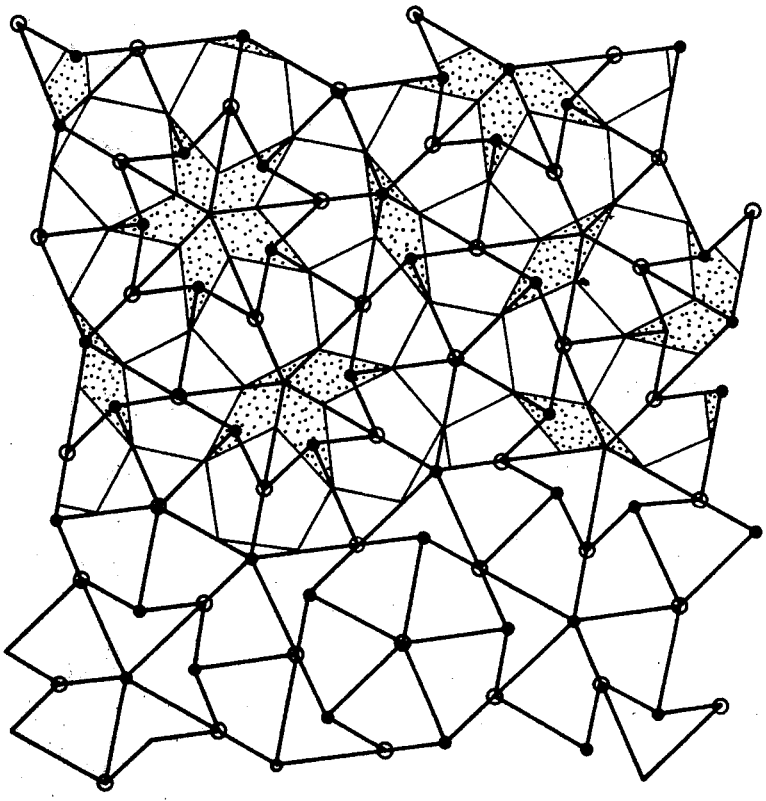
FIG. 14 shows a section of an assembly of tiles of the kind shown in FIGS. 13A and 13B, part of which illustrates the development of the overall pattern of markings.

The same tiles as those illustrated in FIG. 10 may be marked on their reverse faces to emphasise the build up of the array, and suitable markings are shown in FIGS. 12A and 12B. This corresponds to marking the basic pentaplex pair in the manner shown in FIGS. 13A and 13B, and the type of assembly built up in this way can be seen in FIG. 14, part of which shows the markings. Once again, the existence of five-fold symmetry in selected short-range areas is clearly observable, with breakdown at intermediate ranges.

Figure 15:
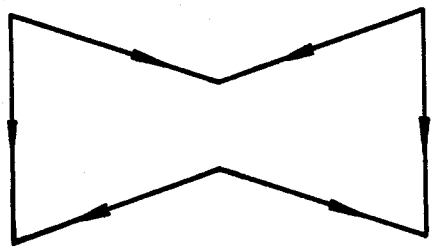
FIG. 15 shows a "foreign" piece for use in conjunction with tiles shaped according to the figures of the first pentaplex pair.
Figure 16:
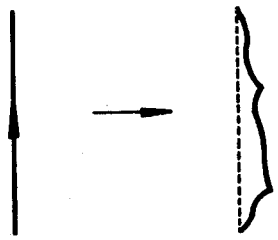
FIG. 16 shows a modification of the shape of the "foreign" piece of FIG. 15 for use with tiles of the kind shown in FIGS. 10A and 10B.
Figure 17:
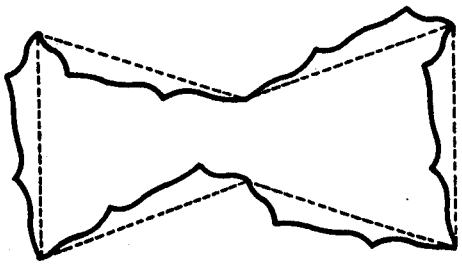
FIG. 17 shows the "foreign" piece of FIG. 15 modified in accordance with FIG. 16.

In order to add further variation to the juxtaposition of tiles according to the invention, "foreign" pieces, such as that shown in FIG. 15 may be used. Such a piece is designed in such a manner that it may be incorporated into an assembly of "pentaplex" tiles, but it differs from them in shape. Thus, the tile of FIG. 15 has the appropriate angle, but has six equal sides. The result of using this "foreign" tile to start an assembly is that the juxtaposition of tiles is predetermined. The edges of a "foreign" piece may of course be varied in a manner similar to that adopted for standard tiles, as shown in FIGS. 16 and 17.

The rules for playing a game according to the invention may be given in different forms. In the first place one can play a form of solitaire. A large supply of pieces is presented, the pieces being designed according to one of the pentaplex pairs, coloured or modified in one of the ways indicated above. One may simply play with the pieces and cover as large an area as possible, producing many intriguing and ever-varying patterns in the process. Included with the supply of pieces could be a large piece of paper or card on which is depicted a large coloured spot. The object of the game would be to cover the spot completely with non-overlapping pieces so that none of the colour of the spot shows through. The game can be made more complicated and more specific in various ways. For example, a single "foreign" piece may be added, such as that given in FIG. 15 for the first pentaplex, or its bird modification. If this "foreign" piece is incorporated into the pattern, then the rest of the pattern (when completed to infinity) is absolutely unique. Thus, for example, if the "foreign" piece is placed initially at the centre of the coloured spot it is quite a difficult puzzle to complete the pattern to cover the spot completely (assuming the spot is rather large). Various alternative "foreign" pieces may be supplied.

Another puzzle would be to fill an area with a specified boundary, but this would be rather easier.

A game for two players could be as follows. First, the large spot would be opened out and placed on the table or floor. The players would then play alternately by placing one piece on the spot, making sure that each piece is fitted against pieces already placed in the correct fashion. The particular pentaplex pair design of the pieces is assumed to be fixed. Only one design would come in each set. One set would consist of a large number of each of the two kinds of piece — say two hundred of the smaller piece and three hundred and twenty five of the larger one — and there could also be a few different "foreign" pieces extra. The first piece could be a "foreign" piece, if the players choose to play this way, but a "purer" version of the game would be not to use "foreign" pieces at all. The first play would be to the centre of the spot, and there-after all play would have to be made to join on to the array of pieces already placed. Each play must be to cover some of the spot, but need not be entirely within the spot. The first player who cannot place a piece would lose. The player who finally covers the spot would win. But at any stage, a player who has just placed a piece could be challenged by his opponent. When challenged he has to continue to place pieces himself on the spot until it is completely covered. If he succeeds then he wins. If he fails, then the challenger wins. A game for three or more players could follow essentially the same rules.

The virtue of the game lies in the very surprising variety which arises in the fitting together of pieces of only two kinds. As the pattern grows, there is always something new which emerges. The presence of larger and larger regions which have five-fold symmetry is particularly striking.

It will be appreciated from the foregoing description that the present invention provides a game of considerable esthetic appeal, which can be player by one or more players. This esthetic appeal can also be utilized with advantage in the field of architectural decoration, since the patterns produced by juxtaposition of tiles have a combination of both regular and random patterning which gives a certain freshness to the appearance. This can be well appreciated by considering FIG. 4 of FIG. 14 as a section of a floor covering made up of tiles shaped according to the respective pentaplex pairs.

I claim:

1. A set of tiles for covering a plane surface comprising (a) a plurality of identical tiles of a first shape, five of said tiles assembled together around a center of five-fold symmetry mating along identical lines successively spaced by angles of 72° to produce a basic continuous assemblage without interstices or overlaps, and (b) a plurality of identical tiles of a second shape different from said first shape said tiles of said second shape mating with tiles both of said first and said second shape to develop said basic continuous assemblage in all directions without interstices or overlaps to produce a greater assemblage of indefinite extent, said greater assemblage exhibiting localizd features of five-fold symmetry, being non-repeating, and being characterized by the absence of a period parallelogram.

2. A set of tiles according to claim 1 wherein five of said tiles of said second shape assembled together around a center of five-fold symmetry mate along identical lines successively spaced by angles of 72°.

3. A set of tiles according to claim 1 wherein said first shape comprises a quadrilateral with straight sides, and said second shape comprises a quadrilateral with straight sides.

4. A set of tiles according to claim 1 wherein the identical lines, along which the identical tiles of said first shape mate, deviate from straight line form.

5. A set of tiles according to claim 1 wherein the identical lines, along which said identical tiles of said first shape mate, are straight lines.

6. A set of tiles according to claim 1 wherein said identical lines, along which said tiles of said first shape mate, comprise complimentary interlocking edges of adjacent tiles of said first shape.

7. A set of tiles according to claim 1 wherein said tiles of said first shape are flat and said tiles of said second shape are flat.

8. A set of tiles according to claim 1 wherein said tiles of each shape have surface markings.

9. A set of tiles according to claim 1 wherein said tiles have edge markings to indicate a prescribed matching with juxtaposed tiles.

10. A set of tiles according to claim 1 further comprising at least one foreign tile different from the tiles of said first shape and different from the tiles of said second shape said foreign tile having a contour to mate with at least said tiles of said first shape juxtaposed with respect to said foreign tile, the total number of foreign tiles in said greater assemblage being substantially less than the total number of tiles of said first shape and said second shape.

11. A set of tiles according to claim 1 wherein each tile of each shape has the area of quadrilateral with angles which are an integer multiple of 36°.

* * * * *